US005536051A

United States Patent [19]

Morin

[11] Patent Number: 5,536,051

[45] Date of Patent: Jul. 16, 1996

[54] KNOTTING TOOL

[76] Inventor: Edward A. Morin, P.O. Box 25376, Portland, Oreg. 97225-0376

[21] Appl. No.: 391,775

[22] Filed: Feb. 21, 1995

[51] Int. Cl.[6] ..... B65H 69/00

[52] U.S. Cl. ..... 289/17

[58] Field of Search ..... 289/1.2, 1.5, 2, 289/17, 18.1

[56] References Cited

U.S. PATENT DOCUMENTS

| | | | |
|---|---|---|---|
| 2,697,624 | 12/1954 | Thomas et al. | 289/17 |
| 3,630,555 | 12/1971 | Newlin | 289/17 |
| 3,752,516 | 8/1973 | Mumma | 289/17 |
| 3,837,691 | 9/1974 | Smythe | 289/17 |
| 4,029,346 | 6/1977 | Browning | 289/17 |
| 4,101,152 | 7/1978 | Gardipee | 289/17 |
| 4,188,052 | 2/1980 | Browning | 289/17 |
| 4,403,797 | 9/1983 | Ragland, Jr. | 289/17 |
| 4,660,314 | 4/1987 | Janssen et al. | 289/17 |
| 4,864,762 | 9/1989 | Cox | 289/17 |
| 5,236,232 | 8/1993 | Broberg | 289/17 |

FOREIGN PATENT DOCUMENTS

| | | | |
|---|---|---|---|
| 993815 | 6/1965 | United Kingdom | 289/17 |

*Primary Examiner*—Michael A. Neas
*Attorney, Agent, or Firm*—James D. Givnan, Jr.

[57] ABSTRACT

A knotting tool includes an elongate handle with a cord support projecting from the handle. The cord support includes walls about which the cord being knotted is wound. A guideway along the cord support receives cord segments with one of the segments being inserted through multiple windings formed on the cord support. A cord lock is insertable through an aperture in the cord support to temporarily bind a cord segment in place and may be in the form of a paper clip. A notched end of the cord support retains a reversed cord segment in place during knot formation. A deflector in the guideway acts on an inserted end of a cord segment to divert same out of the guideway to facilitate grasping. A method of forming a knot is disclosed using the present tool.

3 Claims, 1 Drawing Sheet

KNOTTING TOOL

BACKGROUND OF THE INVENTION

The present invention concerns a tool facilitating the forming of knots along a strand of cord.

In the assembly of certain items such as rosaries, necklaces, etc., it is often necessary to form knots along a cord. A common knot used in such items is a knot having several turns of the cord with the remaining segments passing in opposite directions through said turns and termed a barrel knot. Such a knot normally requires a degree of skill and dexterity to form same in a repetitive manner.

SUMMARY OF THE INVENTION

The present invention is embodied in a tool about which a length of cord may be formed into a knot with multiple turns or windings.

The tool includes an elongate cord support member on which a cord may be wrapped. Locking means is inserted into the support during knot formation. A cord deflector in said support member assists in exposing a cord end for grasping by the user during knot forming. The support member is shaped to receive inserted cord segments.

A method is disclosed for forming a knot on the support member including positioning of the knot formed along a cord segment. With the present tool a series of knots may be formed and positioned along a cord as desired for the spacing of items, such as beads, therealong.

Important objectives of the present invention include the provision of a simple hand tool of low cost to manufacture which greatly simplifies and expedites the tying of coiled knots along a cord; the provision of a hand tool with which a user may form coiled knots in rapid fashion without being adept at knot tying; a method is disclosed for tool aided forming of a knot in a cord.

BRIEF DESCRIPTION OF THE DRAWINGS

With continuing attention to the drawings.

DETAILED DESCRIPTION OF THE PREFERRED EMBODIMENTS

Figures 1, 2, 3, 4, 5, 6, 7:
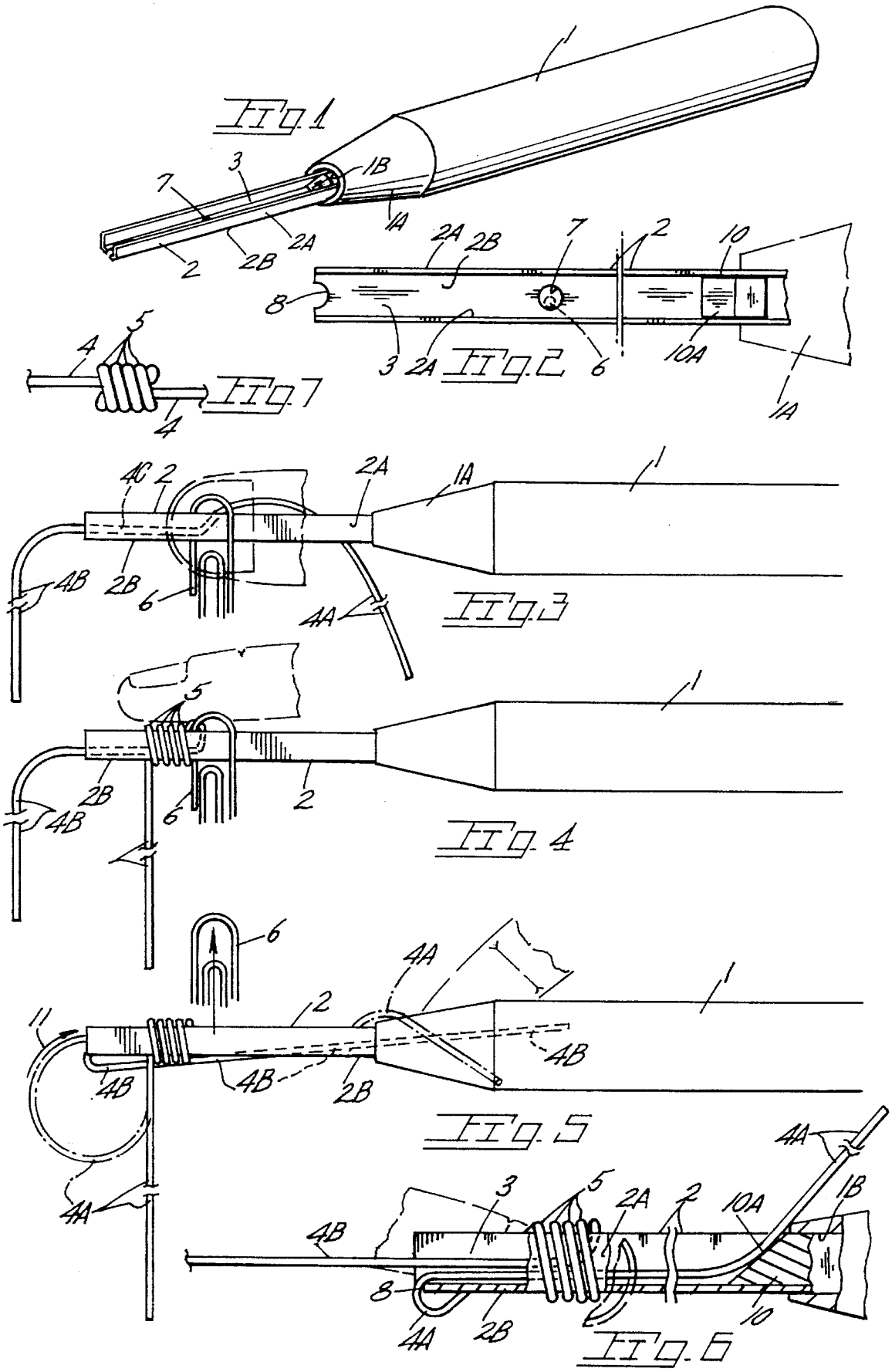
FIG. 1 is a perspective view of the present tool.
FIG. 2 is a fragmentary plan view of the tool shown in FIG. 1.
FIGS. 3, 4, 5 and 6 are front elevational views of the tool showing, in sequence, the formation of a knot with the tool.
FIG. 7 is a front elevational view of a knot with multiple windings.

With continuing attention to the drawings, the present tool includes a handle at reference numeral 1 having a tapered forward portion 1A. A handle bore is at 1B.

Projecting in an axial manner from the tool forward end is an elongate cord support 2 of channel section and having a guideway at 3. Said support additionally serves to receive windings 5 of a cord at 4 as later described. A cord retainer 6 passes through guideway opening 7 when in use to retain or lock the cord in place during tool use.

Aperture 7 receives cord retainer 6, which may be in the form of a sprung paper clip, which serves in a temporary manner to bind the cord against a side wall 2A of support 2.

Other locking means may be utilized, as for example, a bent segment of wire or the user's index finger in place on windings 5. The distal end of cord support 2 is notched at 8.

Cord support 2 may be of channel section with side walls 2A and a bottom wall 2B. Cord segments are at 4A–4B while an intermediate cord segment is at 4C for initial placement in guideway 3.

With regard to use of the tool, the cord to be knotted is placed with intermediate segment 4C in guideway 3 of cord support 2 with said segment being closely adjacent that portion of the cord on which the knot is to be formed. Cord retainer 6 is subsequently inserted through aperture 7 and the right hand thumb, per FIG. 3, pressed there against to pinch cord segment 4C against the inner side of cord support wall 2A.

With the left hand, the user brings cord segment 4A back around and under cord support 2 and winds the cord (counter clockwise as viewed from the end of core support 2) thereabout to render a number of cord windings at 5 as shown in FIG. 4. Cord segment 4B is there-after relocated and tensioned in the direction of handle 1 and placed alongside the unseen side of handle 1 per FIG. 5 and held there against by the user's right index finger. Notch 8, at the distal end of cord support 2, keeps the rearwardly directed cord segment 4B from slipping off the distal end of cord support 2.

Cord retainer 6, if used, is then removed upwardly as shown in FIG. 5. Cord segment 4A is subsequently inserted lengthwise rearwardly along cord support 2, per arrow 11, through the windings 5 to the extent the leading end of the segment encounters a cord deflector 10 in guideway 3 adjacent the handle and is diverted outwardly by inclined surface 10A of the cord support for grasping by the user's left hand, whereupon cord segment 4A is drawn to the right of FIG. 5 until snug.

Subsequently, the left hand grasps the end of cord segment 4B and swings same about the notched end of cord support 2 so as to be generally aligned with the cord support, as seen in FIG. 6. With the thumb and index finger of the left hand, the windings 5 are removed as a coil from support 2 while the right hand grasps segment 4A adjacent the windings to hold same lightly tensioned. At this point the windings are rolled back and forth between the index finger and thumb of the left hand to work the coil with a gentle pull to the left as viewed in FIG. 6 to the location desired along segment 4B.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

1. A tool facilitating the forming of knots having windings at intervals along a cord and including, an elongate cord support of channel cross section having a bottom wall and about which a portion of the cord may be wound and defining a guideway, said bottom wall having an aperture spaced from a support end, a handle at one end of said cord support, and said cord support terminating at a distal end defining a notch, said guideway permitting inserted passage of a cord end through a wound portion of the cord in place on said cord support, a cord retainer normally insertable through said aperture in said bottom wall and engageable with said cord to bind same against said support.

2. The tool claimed in claim 1 wherein said cord support includes an inclined surface to deflect a cord end from said guideway and positioning the cord end for grasping.

3. A tool facilitating the typing of knots at intervals along a cord and comprising, a handle of elongate shape, an elongate cord support of channel section having one end engaged with said handle and having wall structure defining a lengthwise extending guideway for cord reception and having an outer surface about which a cord may be wound during knot forming, said cord support defining an aperture located intermediate the extremities of said cord support and a notch at its distal end, a cord lock for insertion through said aperture and lateral engagement with the cord to bind the cord against the wall structure.

* * * * *